US006684507B2

(12) United States Patent
Lau et al.

(10) Patent No.: US 6,684,507 B2
(45) Date of Patent: Feb. 3, 2004

(54) MULTI-POSITIONABLE HAIR TRIMMER

(75) Inventors: Tung Yan Lau, Shatin (HK); John Wilcox, Newport, RI (US)

(73) Assignee: Remington Corporation, L.L.C., Brigdeport, CT (US)

( * ) Notice: Subject to any disclaimer, the term of this patent is extended or adjusted under 35 U.S.C. 154(b) by 0 days.

(21) Appl. No.: 10/338,102

(22) Filed: Jan. 7, 2003

(65) Prior Publication Data

US 2003/0126744 A1 Jul. 10, 2003

Related U.S. Application Data

(60) Provisional application No. 60/346,477, filed on Jan. 8, 2002.

(51) Int. Cl.[7] ..... B26B 19/06

(52) U.S. Cl. ..... 30/34.1; 30/122; 30/123; 30/216

(58) Field of Search ..... 30/34.05, 34.1, 30/43, 122, 12.3, 29.5, 43.92, 210, 216, 197, 123

(56) References Cited

U.S. PATENT DOCUMENTS 1,380,272 A * 5/1921 Tomasulo ..... 30/197
1,519,601 A * 12/1924 Tomasulo ..... 30/216
2,484,610 A * 10/1949 Cromonic ..... 30/210
5,105,541 A * 4/1992 Messinger et al. ..... 30/34.1
2002/0073550 A1 * 6/2002 Long et al. ..... 30/41.6

FOREIGN PATENT DOCUMENTS

JP 4-322689 * 11/1992

* cited by examiner

*Primary Examiner*—Hwei-Siu Payer
(74) *Attorney, Agent, or Firm*—Melvin I. Stoltz

(57) ABSTRACT

By providing a dual cutting head module which is constructed for precisely cutting beards and mustaches in a wide variety of alternate widths using one cutting blade, while also trimming and cutting nose/ear hair using a second cutting blade, an easily employed, dependable, reliable, multi-purpose beard/mustache and nose/ear hair trimming system is achieved. In one embodiment, the dual cutting blade head member is constructed for removable mounted engagement with the support base, as well as being arcuately pivotable relative thereto, enabling either of the two desired cutting blades to be moved into the operating position whenever desired by the user. In an alternate embodiment, the dual cutting blade head member is mounted to the support base for pivotable movement only, enabling the desired multi-purpose use and operation to be provided, with reduced simplicity in manufacturing.

14 Claims, 11 Drawing Sheets

MULTI-POSITIONABLE HAIR TRIMMER

RELATED APPLICATIONS

This application is related to U.S. Provisional Patent Application Ser. No. 60/346,477, filed Jan. 8, 2002, entitled MULTI-POSITIONABLE HAIR TRIMMER.

TECHNICAL FIELD

This invention relates to beard, mustache, ear, and nose hair trimmers and, more particularly, to movable cutting elements for such trimmers.

BACKGROUND ART

During the last many years, individuals have been increasingly drawn to the advantages provided by electric shaver's and electric hair trimmers. In general, the consuming public has found that the use of scissors, razors, and other cutting systems are extremely inconvenient for removing, trimming, or maintaining beards, mustaches, and hair lengths. In particular, cutting or trimming children's hair is often difficult with prior art methods. In addition, with the ever-increasing time constraints and commitments individuals typically encounter, a fast and effective trimming or cutting system is most desirable.

Through the years, numerous alternate constructions have been created for hair trimmers, particularly suited for beards, mustaches, nose and ear hair. Most of these prior art systems employ similar cutting systems. Typically, one fixed blade and one movable blade cooperate to perform the hair or whisker cutting function.

In order to provide a hair trimmer which is capable of being used in a wide variety of alternate hair cutting situations, prior art systems employ a comb element associated with the hair trimmer which is movably adjustable relative to the cutting blades, in order to allow the user to control the length at which the hair fibers are cut. Unfortunately, prior art constructions have been incapable of providing an adjustable comb element which is easy to employ, while also assuring secure locked engagement of the comb element in any desired position.

Typically, in these prior art constructions, the comb element is either extremely difficult to move or to adjust between its alternate positions. Alternatively, in those prior art systems where movement of the comb element is capable of being achieved with reasonable ease or convenience, the comb element is not securely retained in any desired position. Instead, the comb element easily returns to its original position, whenever any pressure is applied to the comb element.

This unwanted movement of the comb element is extremely difficult for the user to endure, since the user is attempting to cut the beard, mustache, or hair fibers to a specific length. In this regard, whenever the position of the comb element moves during use, the hair fibers are cut to a substantially different length and the desired uniformity or consistency is lost.

In attempting to eliminate these problems, many prior art systems have been developed which are specifically constructed with cutting blades having narrow cutting surfaces, in order to allow consumers to obtain the detailed cutting desired for beards and mustaches, and for cutting and trimming nose and ear hair. Although such prior art systems have been successful in satisfying the various needs of consumers, no universal cutting or trimming system has been developed which satisfies all of the typical needs of a user. As a result, multiple cutting systems are required, causing consumers to incur substantially added cost and maintenance difficulties.

Therefore, it is a principal object of the present invention to provide a beard and mustache trimmer system which is easy to employ and incorporates two separate and independent blade assemblies of different widths for enabling any desired area to be cut.

Another object of the present invention is to provide a beard and mustache trimmer system having the characteristic features described above which enables the user to quickly and easily switch between either blade assembly.

Another object of the present invention is to provide a beard and mustache trimmer system having the characteristic features described above wherein the blade assemblies are formed on a cutting blade module which is rotatable relative to the support base.

Another object of the present invention is to provide a beard and mustache trimmer system having the characteristic features described above wherein the cutter blade module is removable from the base.

Other and more specific objects will in part be obvious and will in part appear hereinafter.

SUMMARY OF THE INVENTION

By employing the present invention, all of the difficulties and drawbacks found in the prior art are completely eliminated and an easily employed, dependable, reliable, multipurpose beard/mustache and nose/ear hair trimming system is achieved. In accordance with the present invention, a dual cutting head module is provided which is constructed for precisely cutting beards and mustaches in a wide variety of alternate widths using one cutting blade, while also trimming and cutting nose/ear hair using a second cutting blade. As a result, a single cutting system is achieved, whereas prior art systems require multiple, separate, and independent cutting systems.

In the present invention, a single support base is employed which incorporates a drive system constructed for cooperative driving engagement with a removable and/or pivotable dual cutting blade head member. In the preferred construction, the dual cutting blade head member incorporates a first cutting blade formed thereon which is constructed for providing the desired beard/mustache trimming capabilities, while also incorporating a smaller, more narrow cutting blade formed on the opposed end thereof, specifically constructed for cutting and trimming nose/ear hair.

In accordance with one embodiment of the present invention, the dual cutting blade head member is constructed for removable mounted engagement with the support base, as well as being arcuately pivotable relative thereto, enabling either of the two desired cutting blades to be moved into the operating position whenever desired by the user. In addition, the user is also able to completely remove the dual cutting blade head member from the support base for cleaning and maintenance, as well as for selecting the desired cutting end to be employed. As a result, ease of operation and multi-purpose use is realized.

In an alternate embodiment, the dual cutting blade head member is mounted to the support base for pivotable movement only. In this way, the desired multi-purpose use and operation ease is provided, with reduced simplicity in manufacturing.

In order to achieve the multipurpose, dual cutting trimming system of the present invention, the single support base incorporates a drive motor and a movable drive system which is selectively engageable and disengageable from the dual blade head member. In this way, the desired cutting blade can be selected and easily operated by activating the motor contained in the support base. In addition, once the dual blade head member has been employed, its quick and easy removability from the support base enables the cutting blades to be quickly and easily cleaned whenever required.

In the preferred construction of the present invention, the support base incorporates a locking member which securely affixes the removable dual blade head member to the support base when desired or, alternatively, secures the pivotable dual blade head member in either of its two alternate positions. In addition, when removability is sought, the removable embodiment provides for the simple movement of a single release button to allow the dual blade cutting head to be removed from the support base.

Furthermore, in both embodiments, the release member also engages and disengages the drive arm connected to the drive motor. As a result, the single activation button assures that the removable cutting blade head member, or the pivotable cutting head member is securely mounted to the drive motor whenever the cutting head member is positioned in direct mounted engagement with the support base in a desired position.

In both preferred embodiments, the dual blade cutting head member is capable of being rotated in position when securely mounted to the support base. As a result, the particular cutting blades to be employed is quickly and easily selected. Furthermore, to assure that complete positioning of the cutting blades is achieved, position alignment zones are formed in the support base for enabling the cutting head to be pivoted and mounted in position with the support base, in the precisely desired location.

As is evident from the foregoing detailed disclosure, the present invention achieves a single product which enables two separate and independent cutting blades to be selectively movable into an operating position for allowing the user to cut or trim a beard or mustache using one cutting blade and then quickly and easily switch to a second cutting blade for trimming nose and ear hair. As result, a single system is employed for achieving what previously could only be achieved using multiple, separate units.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

Figure 12:
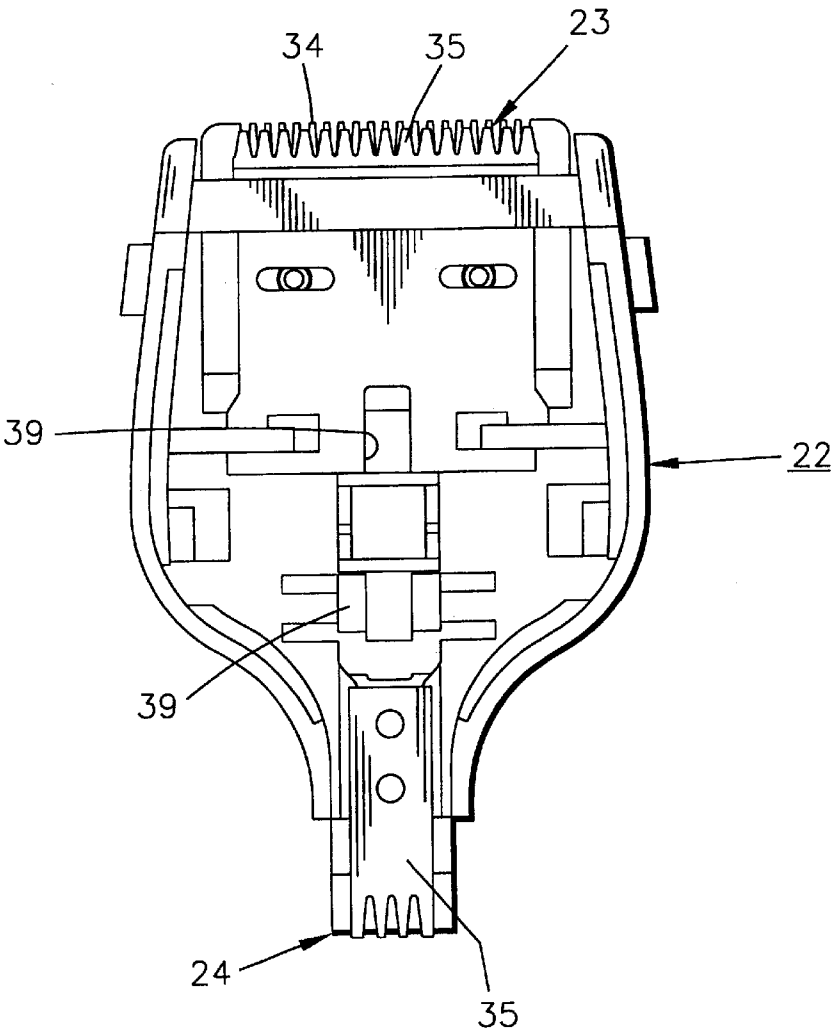
Figure 2A:
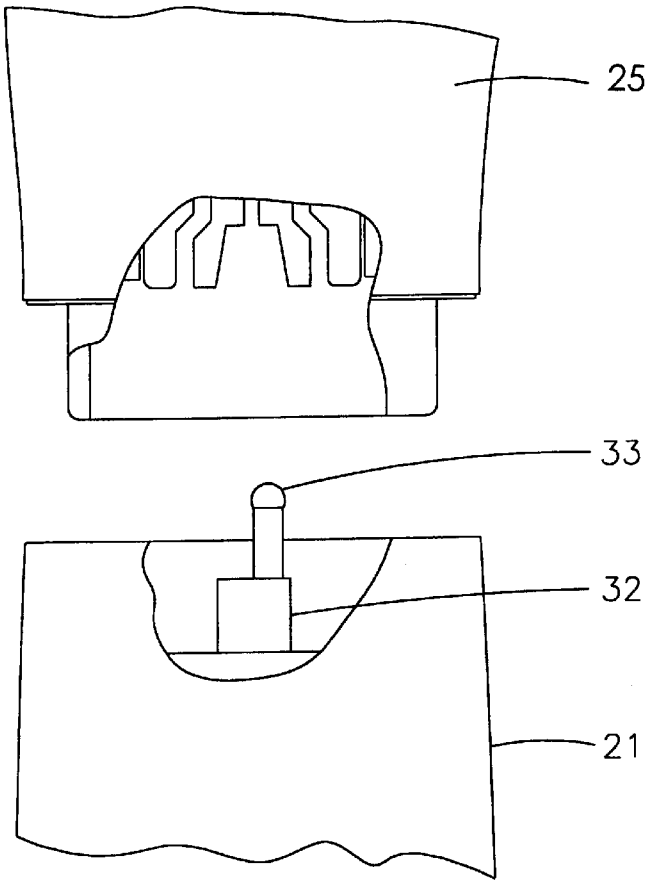
FIG. 2A is an exploded front elevation view, partially broken away, depicting the upper housing separated from the support base.
Figure 3:
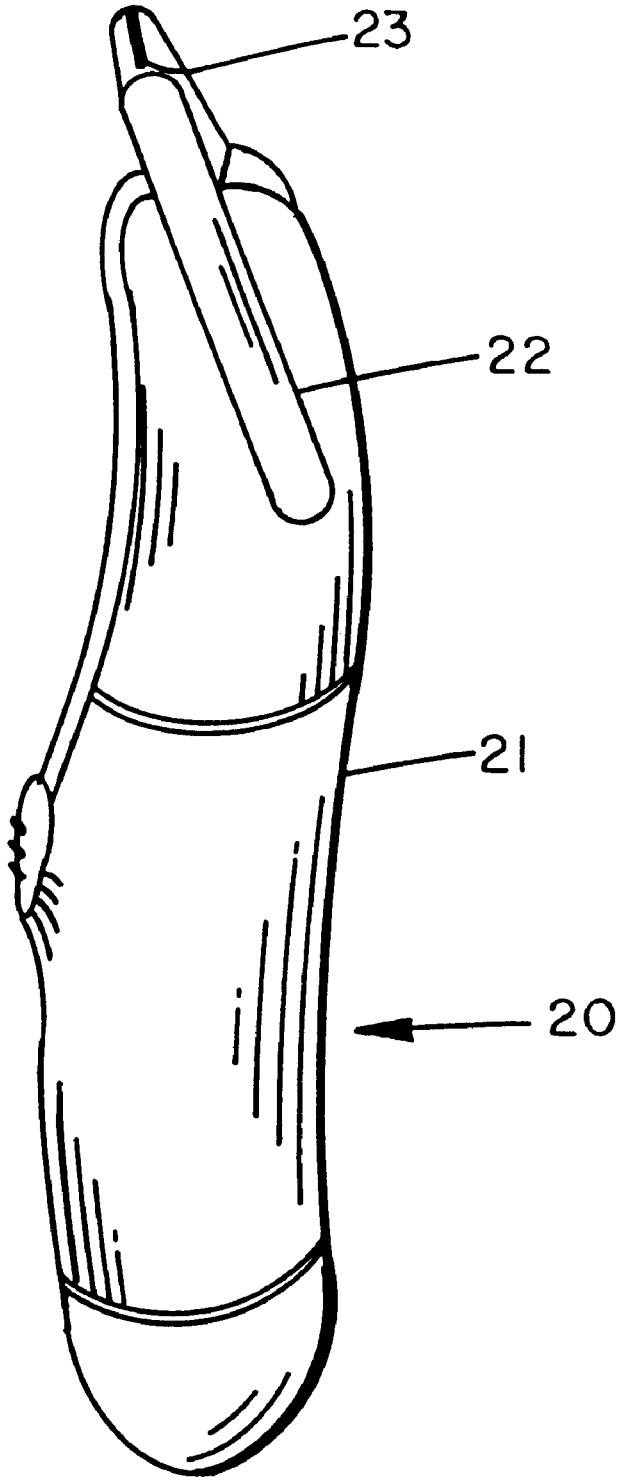
FIG. 3 is a side elevation view of the dual head cutting and trimming system of FIG. 1.
Figure 4:
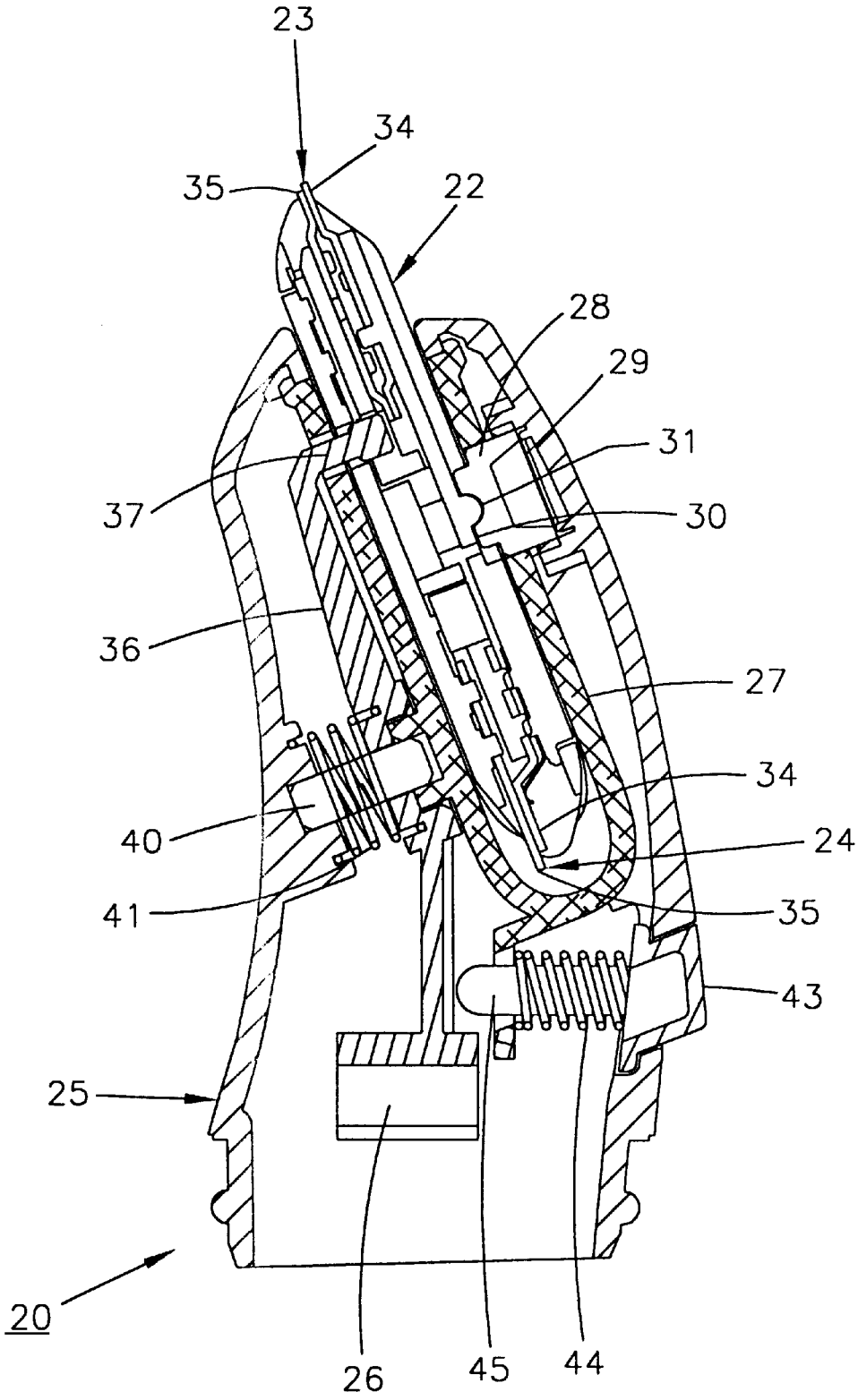
FIG. 4 is a cross-sectional side elevation view of one embodiment of the dual head cutting and trimming system of the present invention shown with the dual cutting blades module in its operating position.
Figure 7:
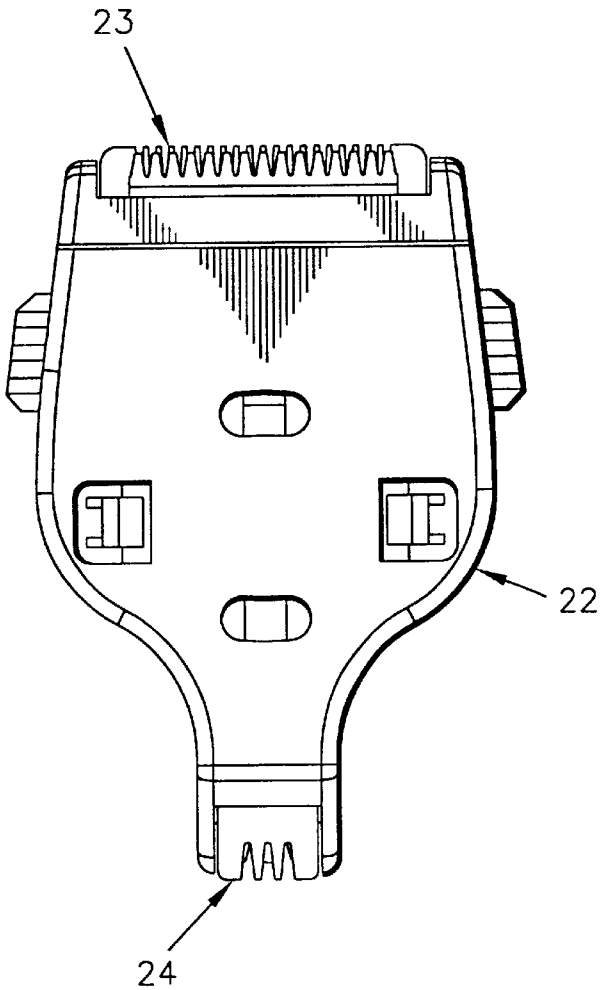
Figure 6:
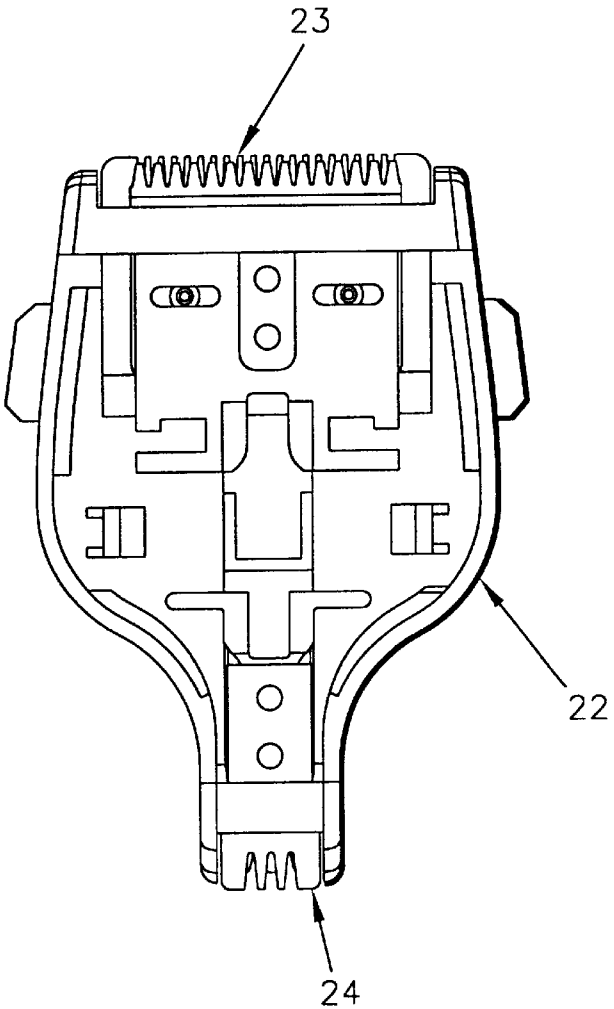
Figure 9:
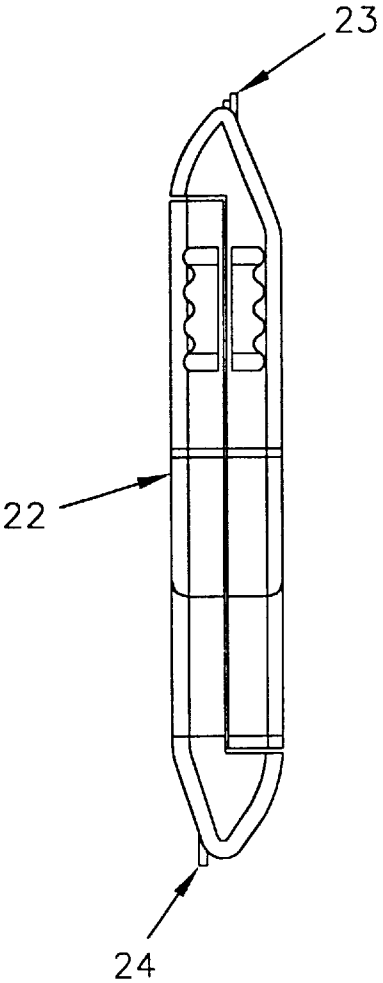
Figure 8:
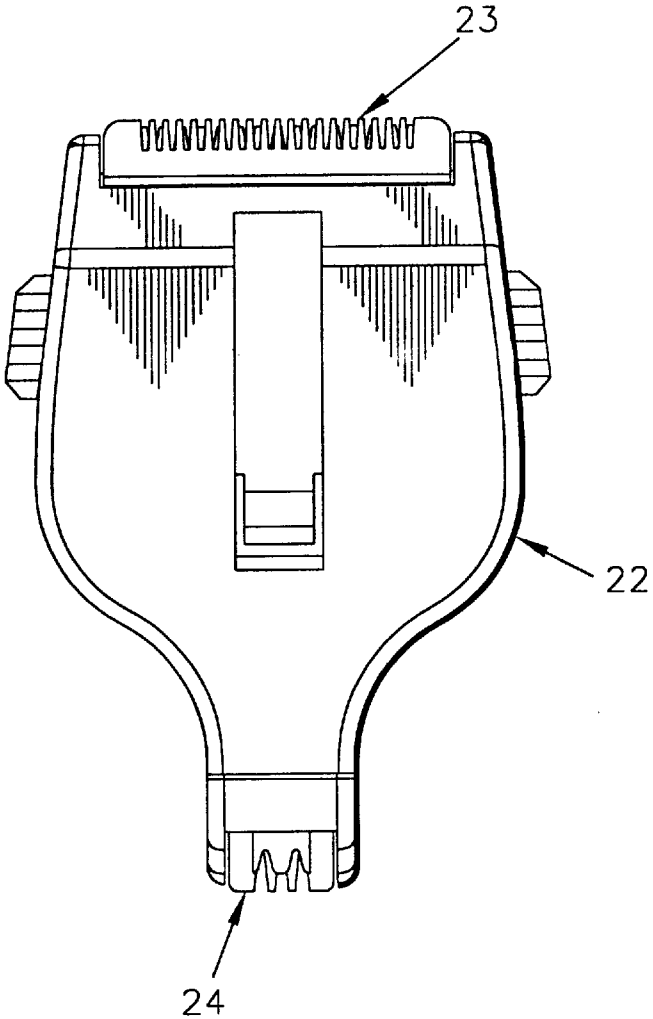
Figure 11:
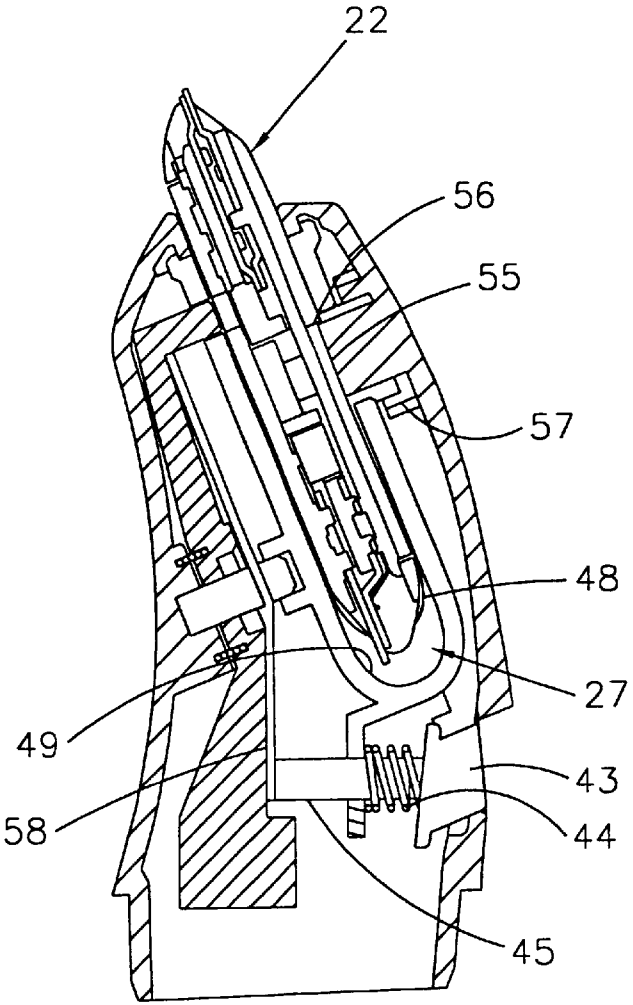
Figure 10:
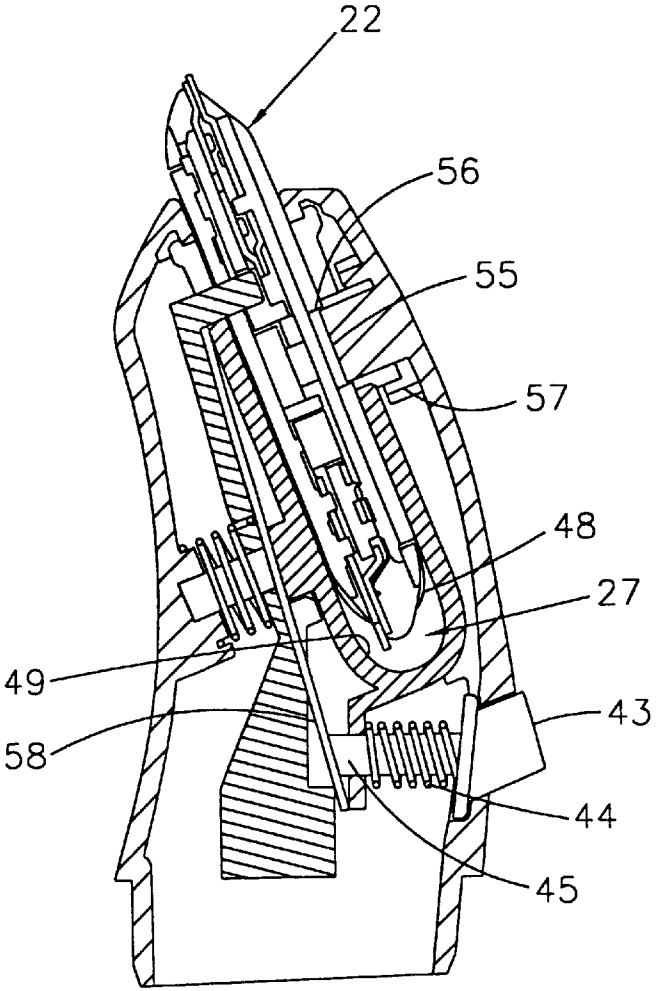
Figure 13:
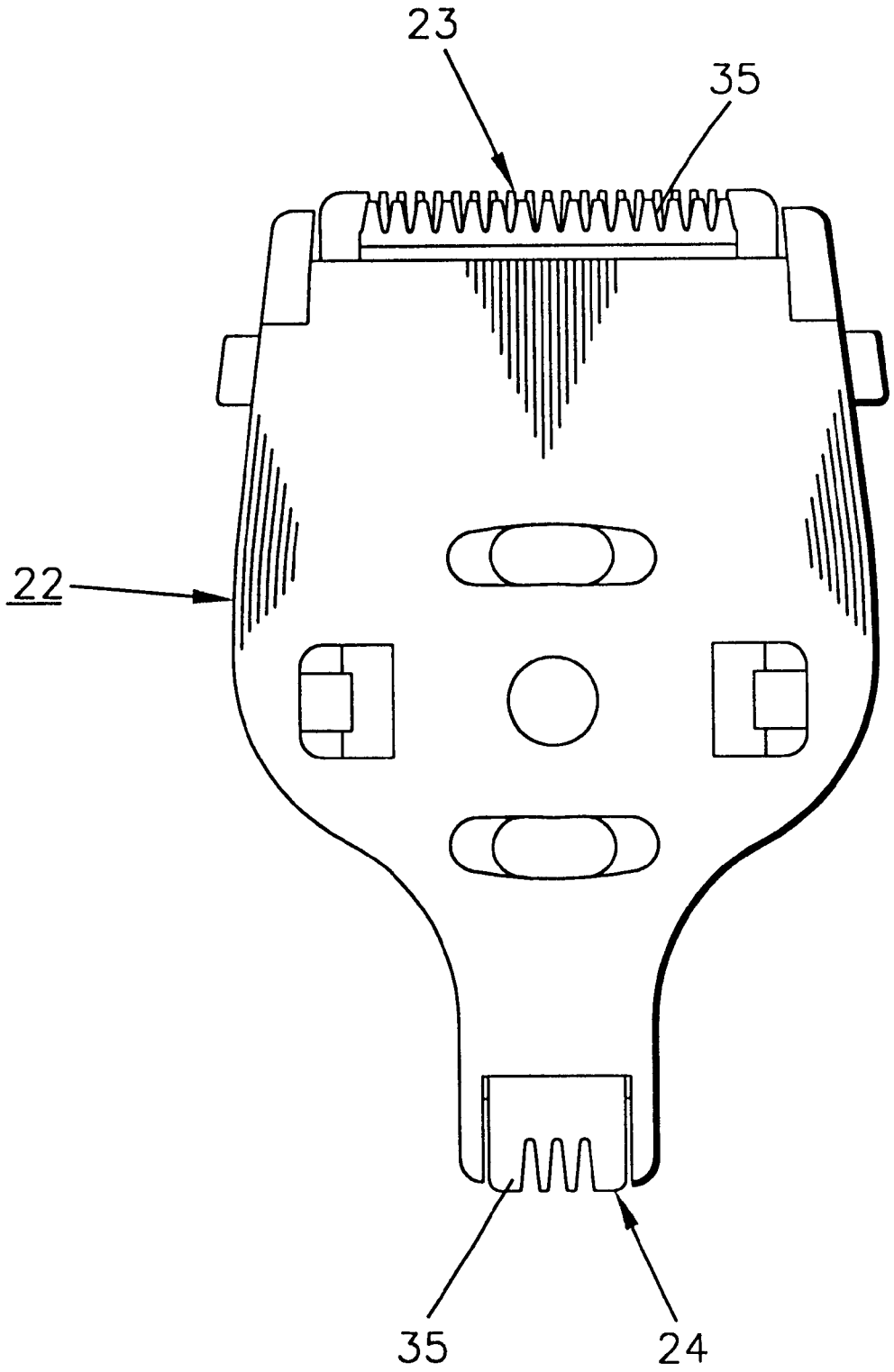
Figure 15:
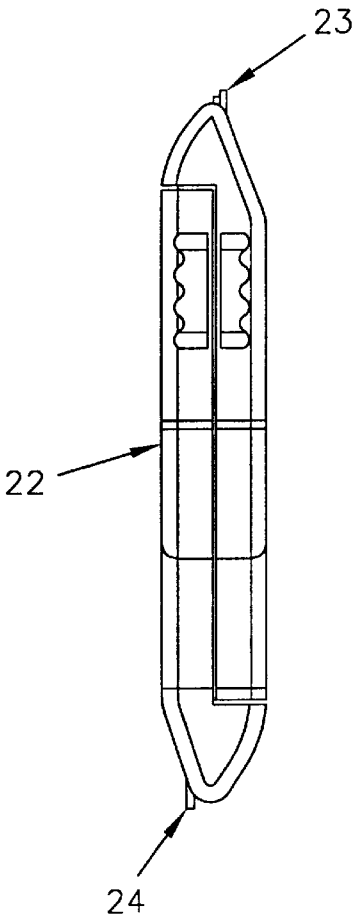
Figure 14:
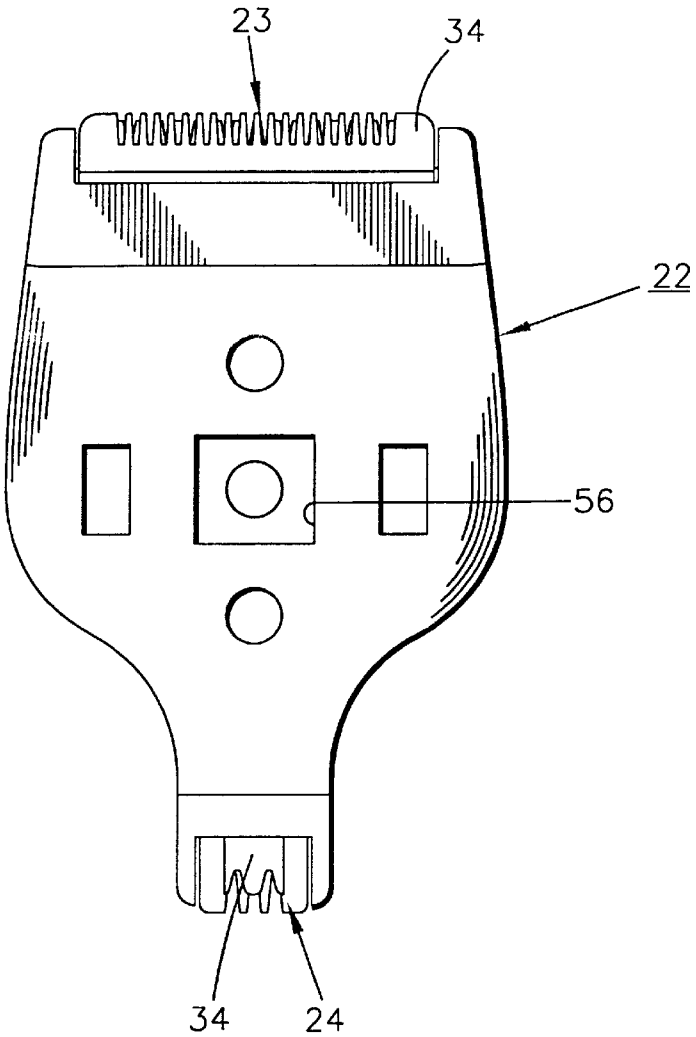

FIGS. 6, 7, and 8 are plan views of the dual cutting blade module of FIG. 4;

FIG. 9 is a side view of the dual cutting blade module of FIG. 4;

FIG. 10 is a cross-sectional side elevation view of a second embodiment of the dual head cutting and trimming system of the present invention shown with the dual cutting blades module in its operating position;

FIG. 11 is a cross-sectional side elevation view of the dual head cutting and trimming system of FIG. 10 shown with the dual cutting blade module in the disengaged or released position;

FIGS. 12, 13, and 14 are plan views of the dual cutting blade module of FIG. 10; and FIG. 15 is a side view of the dual cutting blade module of FIG. 10.

DETAILED DISCLOSURE

By referring to FIGS. 1–15, along with the following detailed disclosure, the construction and operation of the dual head cutting and trimming system of the present invention can best be understood. In this regard, two preferred embodiments of the present invention are fully disclosed and detailed. However, alternate constructions can be made to this system without departing from the scope of the present invention. Consequently, it is to be understood that the embodiments disclosed in the Figures and detailed herein are provided for exemplary purposes only, and are not intended as a limitation of the present invention.

As shown in FIGS. 1–15, dual head cutting and trimming system 20 incorporates lower support base 21 and removable upper housing 25, within which dual cutting blade module or head member 22 is mounted. In the preferred constructions, dual cutting blade module or head member 22 comprises cutting blade assembly 23 which is specifically dimensioned for precisely trimming beards and mustaches, while also incorporating cutting blade assembly 24, specifically dimensioned for cutting and trimming nose and ear hair.

Figure 1:
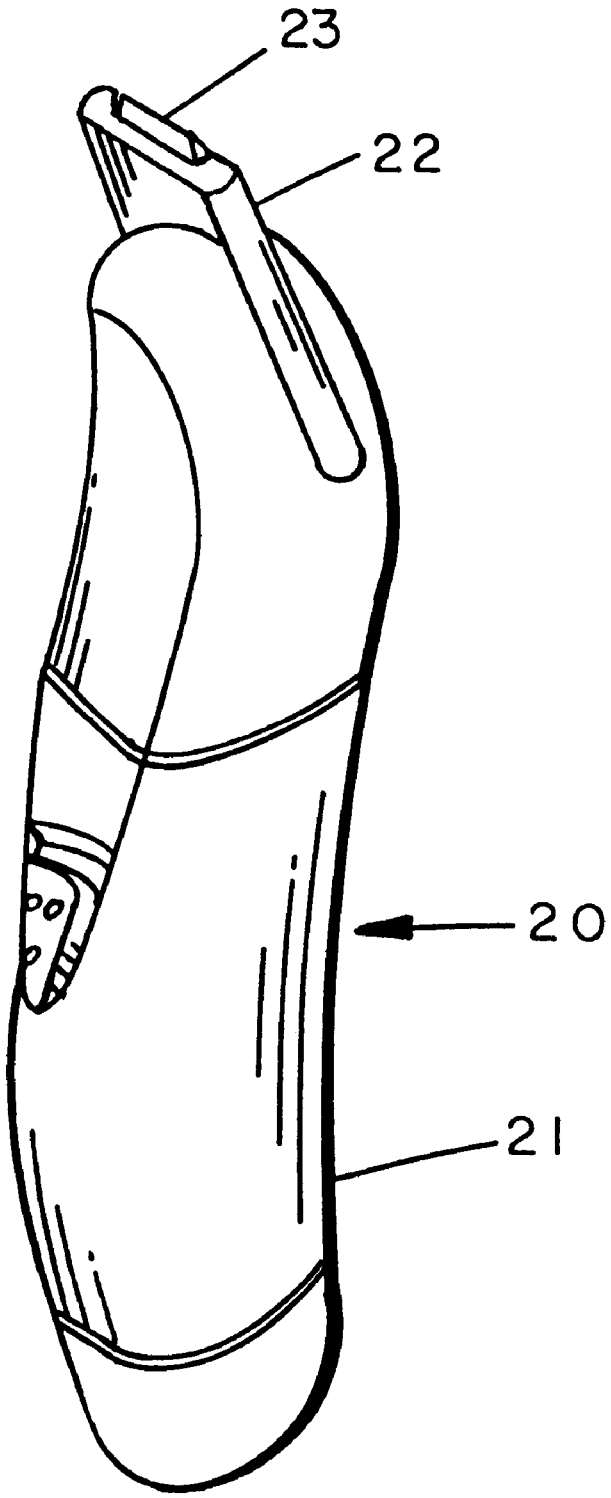
FIG. 1 is a front perspective view of the dual head cutting and trimming system of the present invention with the beard/mustache cutting blade mounted in the operating position.
Figure 2:
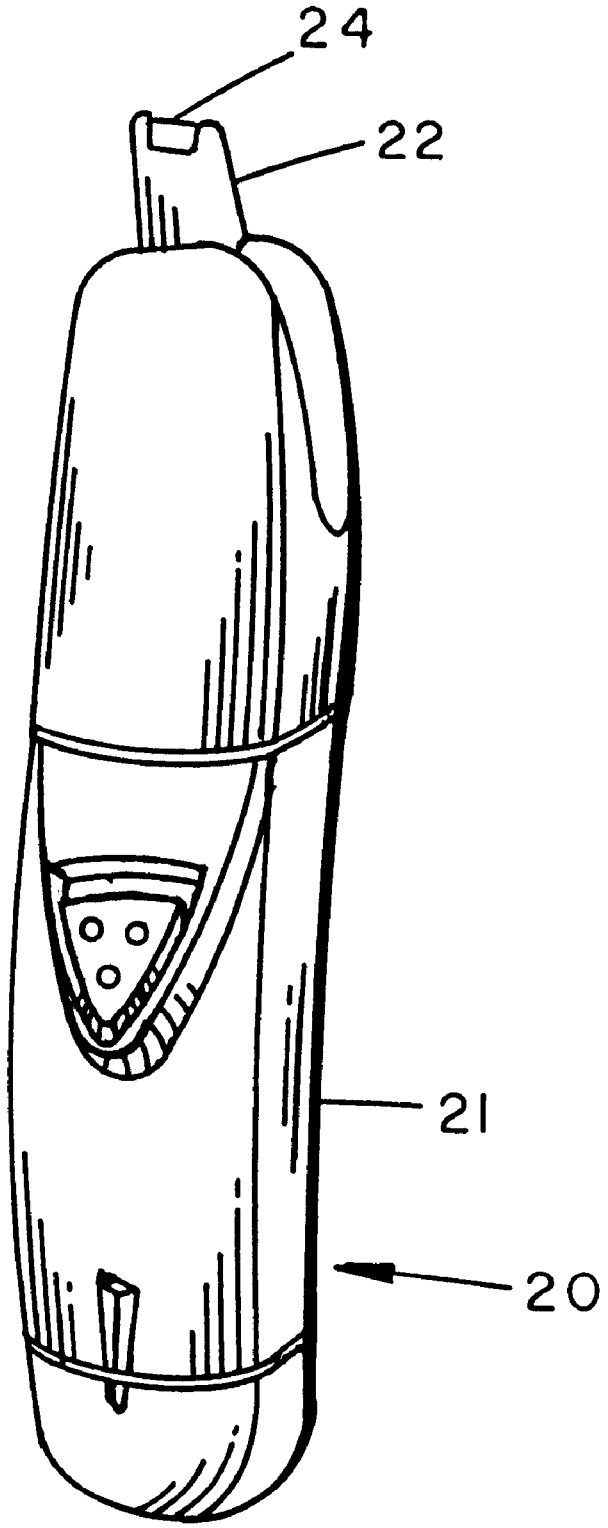
FIG. 2 is a front perspective view of the dual head cutting and trimming system of the present invention with the nose/ear hair trimming cutting blade mounted in the operating position.

Furthermore, as shown in FIG. 2, lower housing 21 incorporates drive motor 32 to which eccentrically mounted pin 33 is mounted for continuous rotation when activated. In addition, pin engaging fork 26 is mounted in upper housing 25 for controlled driving engagement with pin 33 when fully assembled. In this way, the desired movement of the cutting blades is realized.

As more fully detailed below, cutting blade assembly 23 is formed at one end of dual cutting blade module/head member 22, while cutting blade assembly 24 is formed at the opposed end of dual cutting blade module/head member 22. In addition, both cutting blade assemblies 23 and 24 are constructed in a generally conventional manner, with each assembly comprising two blade members which incorporate toothed cutting edges and are mounted in cooperating relationship with each other. In addition, one of said blade members is fixedly mounted, while the other blade member is constructed for reciprocating movement relative thereto. In this way, the desired cutting action is achieved.

As is fully detailed herein, by employing the present invention, a single, dual cutting blade module 22 is selectively movable on upper housing 25 in any desired position, in order to provide the precise hair trimming or cutting blade desired for a particular operation. Regardless of which blade assembly is selected, the placement of dual cutting blade module 22 in upper housing 25, with upper housing 25 mounted to support base 21, assures driving engagement of the desired cutting blade with the motor contained in support base 21, in order to achieve the desired cutting action.

By referring to the following detailed disclosure, along with FIGS. 4–9, the preferred construction and operation of one embodiment of the present invention can best be understood. In this embodiment, dual cutting blade module 22 is removably mounted to upper housing 25 of system 20, while also being rotationally movable in upper housing 25.

In the preferred construction, upper housing 25 incorporates receiving and holding zone 27 which is constructed for enabling removable/rotatable dual head cutting blade module/head member 22 to be securely positioned and retained therein. In the preferred construction, zone 27 is defined by two, juxtaposed, spaced, facing surfaces or walls 48 and 49. In addition, upper housing 25 also incorporates retaining plate 28 which is mounted to surface 48 in cooperation with spring means 29 to continuously bias retaining plate 28 into engagement with removable/rotatable dual head cutting blade module 22.

In the preferred construction, retaining plate 28 incorporates a recess or cavity 30 formed in its exposed surface, which is constructed for mating engagement with a raised boss or dimple 31 formed on the outer surface of dual head cutting blade module 22. By employing this construction, positive holding engagement of dual cutting blade module 22 in upper housing 25 is attained, while also enabling dual head cutting blade module 22 to be quickly and easily removed from engagement with upper housing 25. In order to remove dual cutting blade module 22, the user merely advances dual head cutting blade module 22 out of engagement with upper housing 25, using sufficient force to cause retaining plate 28 to move against spring member 29 and release the surface engagement between raised boss or dimple 31 and recess zone 30 of retaining plate 28.

In addition, in the preferred configuration, retaining plate 28 is positioned substantially midway along the length of removable dual head cutting blade module 22. As a result, once dual head cutting blade module 22 is in secure engagement in upper housing 25, dual head cutting module 22 is capable of rotating about the perpendicular axis thereof which extends through raised boss/dimple 31 and recess zone 30 of holding member 28. In this way, the user is able to select the precisely desired cutting blade assembly needed by either entirely removing cutting blade module 22 from upper housing 25 or arcuately rotating cutting blade module 22 relative to support base 21 while retained in its engaged position.

As discussed above, cutting blade assemblies 23 and 24 each comprise fixed blade member 34 and movable blade member 35. As depicted, blade members 34 and 35 are mounted in juxtaposed cooperating relationship with each other, with movable blade member 35 positioned for side to side movement relative to fixed blade member 34, thereby providing the desired cutting action.

In order to achieve the desired movement of blade member 35, support base 21 incorporates drive motor 32, the output of which is directly connected to eccentric pin 33, which is engaged with fork 26 formed at one end of movable arm member 36. In this construction, arm member 36 incorporates a distal drive end or finger member 37 which directly engages movable blade member 35 of each cutting blade assembly 23 and 24 to cause movable blade member 35 to reciprocatingly move in a first plane. As shown in FIG. 12, each movable blade member 35 is controllably connected to lever arm 39 which causes blade member 35 to move as desired. The desired movement is achieved by the reciprocating, pivoting movement of arm member 36 due to the rotation of pin 33 in fork 26.

In addition to providing the desired side to side, reciprocating movement of lever 39 and blade member 35 relative to fixed blade member 34, whenever the motor has been activated, arm member 36 is also capable of lateral movement in its entirety between a first blade member engaged position and a second blade member disengaged position. As a result of this lateral movement of arm member 36, arm member 36 is capable of being disengaged from driving contact with blade member 35 when in its second position.

In order to control the lateral movement of arm member 36, upper housing 25 incorporates a guide pin 40 securely mounted to one surface thereof, with spring means 41 peripherally surrounding guide pin 40. In addition, movable arm member 36 is constructed surrounding and engaging guide pin 40 for axial movement relative thereto. In addition, arm member 36 comprises a surface thereof which is in contact with spring means 41. In the preferred construction, spring means 41 comprises a coil spring which is constructed for continuously biasing movable arm member 36 towards dual head cutting blade module 22, thereby normally maintaining arm member 36 engaged with movable blade member 35 of dual head cutting blade module 22.

By employing this construction, movable arm member 36 is normally engaged with cutting blade assembly 23 or 24 in order to provide the desired reciprocating movement for enabling cutting blade assembly 23 and 24 to perform the desired cutting operation. However, whenever dual head cutting blade module 22 is to be removed from support base 21, for cleaning or for being positioned in an alternate orientation, movable arm member 36 must be disengaged from dual head cutting blade module 22.

In order to provide the required lateral movement of arm member 36 relative to dual cutting blade module 22, in order to disengage drive end 37 from cutting blade assembly 23 or 24, pushbutton 43 is employed. Pushbutton 43 is movably mounted to upper housing 25 in combination with coil spring member 44 and elongated rod 45. Pushbutton 43 is constructed for movement between two alternate positions, while spring member 44 is constructed for biasing pushbutton 43 outwardly and maintaining pushbutton 43 in its first position, depicted in FIG. 4.

In addition, elongated rod 45 is mounted within spring member 44 and in controlled engagement with pushbutton 43. In the first position, a portion of rod member 45 extends outwardly from spring member 44 in a direction opposite from pushbutton 43. Furthermore, rod member 45 is positioned for cooperative, controlled engagement with arm member 36.

By employing this construction, the movement of pushbutton 43 from its first position to its second position causes elongated rod member 45 to move axially outwardly from coil spring 44 into engagement with arm member 36. In addition, as elongated rod 45 is axially advanced outwardly from coil spring 44, rod 45 contacts arm 36, causing arm 36 to move laterally along guide pin 40 against the spring forces caused by spring member 41.

Figure 5:
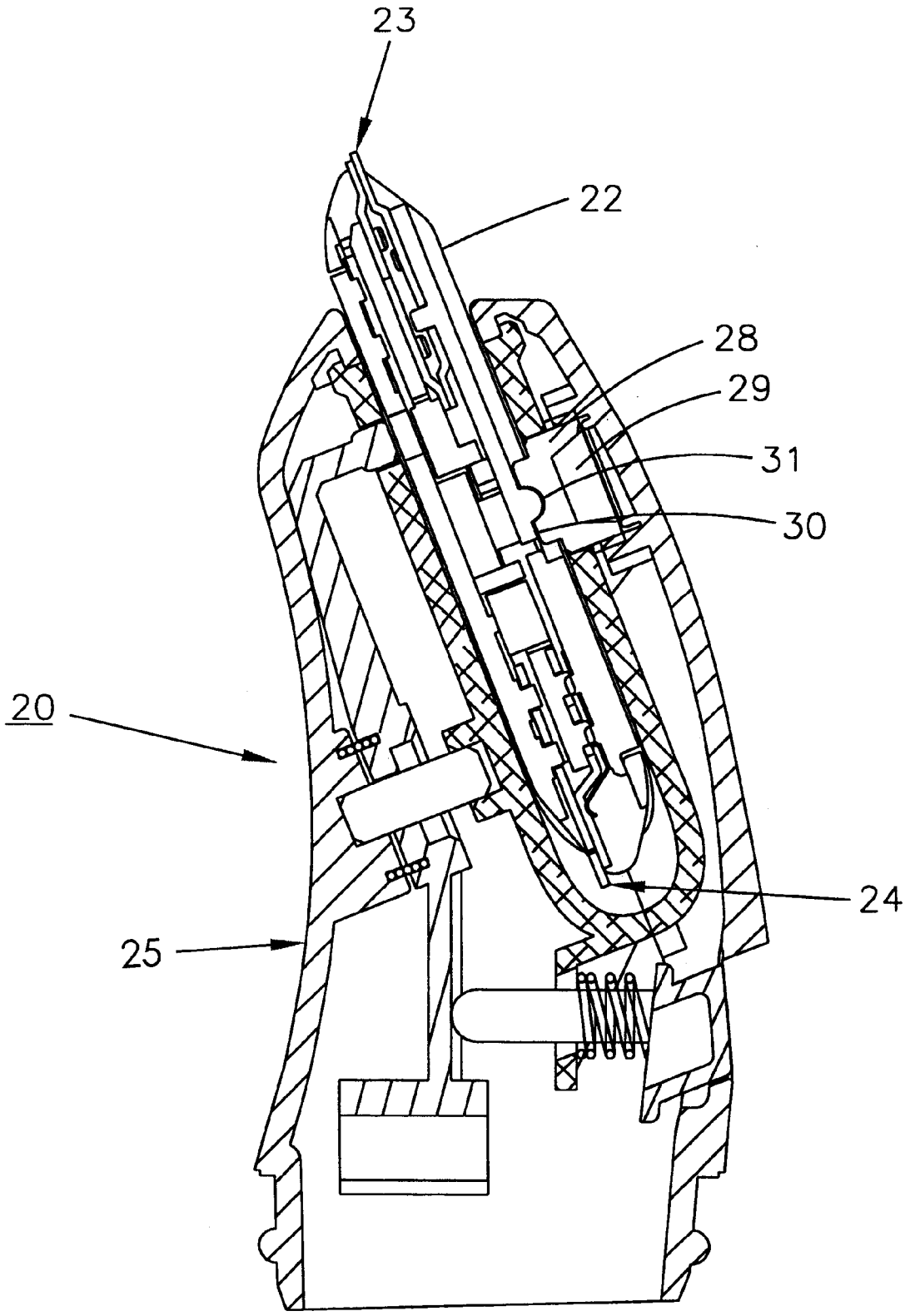
FIG. 5 is a cross-sectional side elevation view of the dual head cutting and trimming system of FIG. 4 shown with the dual cutting blade module in the disengaged or released position.

Once pushbutton 43 has been moved into its second position, elongated rod 45 is advanced completely outwardly from coil spring 44 and arm member 36 has been moved into its second position, completely disengaged from dual head cutting blade module 22. This completely disengaged position is shown in FIG. 5.

Once the activating forces are removed from pushbutton 43, coil spring member 44 causes pushbutton 43 to return to its first position, while spring member 41 causes arm member 36 to automatically advance from the disengaged position into the engaged position. As a result, automatic movement of arm member 36 into its normally engaged and operating position is quickly and easily obtained, whenever the user removes any activation force from pushbutton 43. As a result, quick, easy, and reliable operation of dual blade cutting and trimming system 20 is realized.

In the preferred construction of this embodiment, many of the structural components defined above are also incorporated in this embodiment. Consequently, for ease of description and understanding, the same reference numerals are employed. Furthermore, when not required, a detailed disclosure of these identical components is not provided and the foregoing disclosure is incorporated by reference.

By referring to the following detailed disclosure, along with FIGS. 10–15, the preferred construction and operation of a second preferred embodiment of the present invention can best be understood. In this embodiment, dual cutting blade module 22 is rotationally mounted to upper housing 25 of system 20, while being incapable of being removed from upper housing 25.

In the preferred construction of this embodiment, upper housing 25 incorporates receiving and holding zone 27 which is constructed for enabling removable/rotatable dual head cutting blade module/head member 22 to be securely positioned and retained therein. In the preferred construction, zone 27 is defined by two, juxtaposed, spaced, facing surfaces or walls 48 and 49. In addition, upper housing 25 also incorporates rectangular shaped hub 55 which is mounted to surface 48 for controlled rotational movement relative thereto.

In the preferred construction, hub 55 is constructed for mating engagement with cavity 56 formed on the outer surface of dual head cutting blade module 22. In addition, hub 55 is journalled in surface 48, in combination with a flexible outer ring 57 integrally attached thereto. By constructing outer ring 57 with a plurality of detents, the desired alternate positions for cutting blade module 22 are established, enabling the user to quickly and easily overcome the frictional resistance provided by the detents and rotate cutting blade module 22 into its alternate position.

In addition, in the preferred configuration, hub 55 is positioned substantially midway along the length of dual head cutting blade module 22. As a result, dual head cutting module 22 is capable of easily rotating about the perpendicular axis extending through hub 55 and cavity 56 of cutting blade module 22. In this way, the user is able to quickly and easily select the precisely desired cutting blade assembly needed by merely arcuately rotating cutting blade module 22 relative to support base 21 while retained in position.

As discussed above, cutting blade assemblies 23 and 24 each comprise fixed blade member 34 and movable blade member 35. As depicted, blade members 34 and 35 are mounted in juxtaposed cooperating relationship with each other, with movable blade member 35 positioned for side to side movement relative to fixed blade member 34, thereby providing the desired cutting action.

In order to achieve the desired movement of blade member 35, support base 21 incorporates drive motor 32, the output of which is directly connected to eccentric pin 33, which is engaged with fork 26 formed at one end of movable arm member 36. In this construction, arm member 36 incorporates a distal drive end or finger member 37 which directly engages movable blade member 35 of each cutting blade assembly 23 and 24 to cause movable blade member 35 to reciprocatingly move in a first plane. As shown in FIG. 12, each movable blade member 35 is controllably connected to lever arm 39 which causes blade member 35 to move as desired. The desired movement is achieved by the reciprocating, pivoting movement of arm member 36 due to the rotation of pin 33 in fork 26.

In addition to providing the desired side to side, reciprocating movement of lever arm 39 and blade member 35 relative to fixed blade member 34, whenever the motor has been activated, arm member 36 is also capable of lateral movement in its entirety between a first blade member engaged position and a second blade member disengaged position. As a result of this lateral movement of arm member 36, arm member 36 is capable of being disengaged from driving contact with blade member 35 when in its second position.

In order to control the lateral movement of arm member 36, upper housing 25 incorporates a guide pin 40 securely mounted to one surface thereof, with spring means 41 peripherally surrounding guide pin 40. In addition, movable arm member 36 is constructed surrounding and engaging guide pin 40 for axial movement relative thereto. In addition, arm member 36 comprises a surface thereof which is in contact with spring means 41. In the preferred construction, spring means 41 comprises a coil spring which is constructed for continuously biasing movable arm member 36 towards dual head cutting blade module 22, thereby normally maintaining arm member 36 engaged with movable blade member 35 of dual head cutting blade module 22.

By employing this construction, movable arm member 36 is normally engaged with cutting blade assembly 23 or 24 in order to provide the desired reciprocating movement for enabling cutting blade assembly 23 and 24 to perform the desired cutting operation. However, whenever dual head cutting blade module 22 is to be rotated in support base 21, for cleaning or for being positioned in an alternate orientation, movable arm member 36 must be disengaged from dual head cutting blade module 22.

In order to provide the required lateral movement of arm member 36 relative to dual cutting blade module 22 and disengage drive end 37 from cutting blade assembly 23 or 24, pushbutton 43 is employed. Pushbutton 43 is movably mounted to upper housing 25 in combination with coil spring member 44 and elongated rod 45. Pushbutton 43 is constructed for movement between two alternate positions, while spring member 44 is constructed for biasing pushbutton 43 outwardly and maintaining pushbutton 43 in its first position, depicted in FIG. 10.

In addition, elongated rod 45 is mounted within spring member 44 and in controlled engagement with pushbutton 43. In the first position, a portion of rod member 45 extends outwardly from spring member 44 in a direction opposite from pushbutton 43. Furthermore, rod member 45 is positioned for cooperative, controlled engagement with arm member 36 in combination with plate 58.

In this embodiment, as shown in FIGS. 10 and 11, upper housing 25 comprises elongated control plate 58 mounted in association with arm member 36. In this preferred construction, plate 58 extends substantially the entire length of arm member 36 and is movably mounted to guide pin 40. In addition, plate member 58 is positioned between arm member 36 and rod 45.

By employing this construction, the movement of pushbutton 43 from its first position to its second position causes elongated rod member 45 to move axially outwardly from coil spring 44 into engagement with control plate 58. In addition, as elongated rod 45 is axially advanced outwardly from coil spring 44, rod 45 contacts control plate 58, causing plate 58 and arm 36 to move laterally along guide pin 40 against the spring forces caused by spring member 41. By employing control plate 58, a heavy duty, preferred metallic component is provided which eliminated any possibility of bending of arm 36 and assures the desired movement of arm 36 in its entirety.

Once pushbutton 43 has been moved into its second position, elongated rod 45 is advanced completely outwardly from coil spring 44, and arm member 36, with plate 58, are moved into their second position, with arm member 36 completely disengaged from dual head cutting blade module 22. This completely disengaged position is shown in FIG. 11.

Once the activating forces are removed from pushbutton 43, coil spring member 44 causes pushbutton 43 to return to its first position, while spring member 41 causes arm member 36 and plate 58 to automatically advance from the disengaged position into the engaged position. As a result, automatic movement of arm member 36 into its normally engaged and operating position is quickly and easily obtained, whenever the user removes any activation force from pushbutton 43. As a result, quick, easy, and reliable operation of dual blade cutting and trimming system 20 is realized.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A beard and mustache trimmer system constructed for enabling separate cutting blade assemblies to be alternatively selected for use, said trimmer system comprising:

A. a support base incorporating a drive motor and an eccentrically mounted pin rotationally connected to the drive motor;

B. an upper housing
   a. removably mountable to the support base,
   b. incorporating a movable drive fork engageable with the eccentric pin for controlled movement thereof, and
   c. comprising a holding zone constructed for supportingly retaining a dual cutting blade module/head member therein and enabling the dual cutting blade module/head member to be rotationally moved between its two alternate positions, said holding zone comprising two juxtaposed, spaced, facing surfaces, with at least one of said surfaces incorporating a support plate on which one side of said dual cutting blade module/head member is supportingly retained;

C. a dual cutting blade module or head member,
   a. Incorporating a first cutting blade assembly at one end thereof and a second cutting blade assembly at the opposed end thereof, and
   b. mounted to the upper housing for rotational movement relative thereto and for enabling the first cutting blade assembly to be positioned in an operative location, whenever desired, and also enabling the second cutting blade assembly to be rotated into the operative location, when desired;

whereby a beard and mustache trimmer system is achieved which provides two separate and independent cutting blade assemblies, for use by a consumer, whenever desired, in order to achieve a particular cutting effect or result.

2. The beard and mustache trimmer system defined in claim 1, wherein the support plate mounted to the support surface is further defined as being frictionally journalled in said upper housing for controlling the rotational movement of the dual cutting blade module/head member and requiring sufficient force to overcome the frictional engagement thereof.

3. A beard and mustache trimmer system constructed for enabling separate cutting blade assemblies to be alternatively selected for use, said trimmer system comprising:

A. a support base incorporating a drive motor and an eccentrically mounted pin rotationally connected to the drive motor;

B. an upper housing
   a. removably mountable to the support base,
   b. incorporating a movable drive fork engageable with the eccentric pin for controlled movement thereof, and
   c. comprising an elongated drive arm mounted to the housing for enabling said drive arm to pivot relative thereto, with the drive arm incorporating the drive fork at one end thereof and an upstanding finger member at the opposed end thereof;

C. a dual cutting blade module or head member,
   a. incorporating a first cutting blade assembly at one end thereof and a second cutting blade assembly at the opposed end thereof, and
   b. mounted to the upper housing for rotational movement relative thereto and for enabling the first cutting blade assembly to be positioned in an operative location, whenever desired, and also enabling the second cutting blade assembly to be rotated into the operative location, when desired;

whereby a beard and mustache trimmer system is achieved which provides two separate and independent cutting blade assemblies, for use by a consumer, whenever desired, in order to achieve a particular cutting effect or result.

4. The beard and mustache trimmer system defined in claim 3, wherein the first cutting blade assembly and the second cutting blade assembly each comprise one fixedly mounted blade member and one movable blade member cooperatively associated therewith, each of said movable blade members being connected to a movement control lever for providing side to side, translational movement of the movable blade member relative to the fixedly mounted blade member, thereby obtaining the desired cutting action.

5. The beard and mustache trimmer defined in claim 4, wherein said first cutting blade assembly comprises blade members having a narrow width constructed for cutting and trimming nose and ear hairs, and said second cutting blade assembly comprises blade members having a wider width constructed for cutting and trimming beards and mustaches.

6. The beard and mustache trimmer system defined in claim 3, wherein the movable blade member of each cutting blade assembly is further defined as being controllably driven by the movement of the upstanding finger member of the drive arm engaged with the movement control lever which is controllably driven in a reciprocating arcuate path by the pivoting movement of the drive arm and the movement of the drive fork when engaged with the eccentrically mounted pin.

7. The beard and mustache trimmer system defined in claim 6, wherein the upper housing further comprises a drive arm supporting shaft for retaining the drive arm thereon and enabling said drive arm to arcuately pivot relative thereto, said drive arm supporting shaft also comprising spring means mounted thereon for normally biasing the drive arm into a first, engaged position, wherein the finger member of the drive arm is engaged with the movement control lever of one of said cutting blade assemblies.

8. The beard and mustache trimmer system defined in claim 7, wherein said upper housing further comprises a push button mounted thereto, accessible from an outer surface of said upper housing and constructed for controlling the movement of the drive arm to move between its first engaged position and a second disengaged position, wherein the finger member of the drive arm is disengaged from the movement control lever of the cutting blade assembly.

9. The beard and mustache trimmer system defined in claim 8, wherein the movement of the drive arm into its second position enables the dual cutting blade module/head member to be rotationally moved between its two alternate operating positions.

10. The beard and mustache trimmer system defined in claim 8, wherein said upper housing further comprises an elongated plate member cooperatively associated with the drive arm and the push button for assuring movement of the drive arm in its entirety whenever said push button is activated.

11. A beard and mustache trimmer system constructed for enabling separate cutting blade assemblies to be alternatively selected for use, said trimmer system comprising:

A. a support base incorporating a drive motor and an eccentrically mounted pin rotationally connected to the drive motor;

B. an upper housing
   a. removably mountable to the support base,
   b. incorporating a movable drive fork engageable with the eccentric pin for controlled movement thereof, and C. a dual cutting blade module or head member,
   a. incorporating a first cutting blade assembly at one end thereof and a second cutting blade assembly at the opposed end thereof, and
   b. mounted to the upper housing for rotational movement relative thereto and for enabling the first cutting blade assembly to be positioned in an operative location, whenever desired, and also enabling the second cutting blade assembly to be rotated into the operative location, when desired, and
   c. removably mounted to the upper housing for being separated therefrom in its entirety, whenever desired by a user, whereby a beard and mustache trimmer system is achieved which provides two separate and independent cutting blade assemblies, for use by a consumer, whenever desired, in order to achieve a particular cutting effect or result.

12. The beard and mustache trimmer system defined in claim 11, wherein the upper housing is further defined as comprising a holding zone constructed for supportingly retaining the dual cutting blade module/head member therein and enabling the dual cutting blade module/head member to be rotationally moved therein, while also being removable therefrom in its entirety.

13. The beard and mustache trimmer system defined in claim 12, wherein the holding zone of the upper housing is further defined as being formed by two, juxtaposed, spaced, facing, support surfaces, with at least one of said surfaces incorporating a support member on which one side of said dual cutting blade module/head member is supportingly and removably retained.

14. The beard and mustache trimmer system defined in claim 13, wherein said support member formed on one of said surfaces of the holding zone of the upper housing is further defined as comprising a cavity bearing plate member mounted in said upper housing in cooperating association with spring means and positioned for engaging a raised boss/dimple formed on the outer surface of said dual cutting blade module/head member, whereby said dual cutting blade module/head member is securely retained in the holding zone by the engagement of said boss/dimple in the cavity bearing plate member while also being removable from said holding zone by longitudinally moving the dual cutting blade module/head member with sufficient force to overcome the biased engagement of the cavity bearing plate member with the dimple/boss.

* * * * *